US007804423B2

(12) United States Patent
Mudalige et al.

(10) Patent No.: US 7,804,423 B2
(45) Date of Patent: Sep. 28, 2010

(54) REAL TIME TRAFFIC AIDE

(75) Inventors: Upali Priyantha Mudalige, Troy, MI (US); William C. Lin, Birmingham, MI (US); Rami I. Debouk, Dearborn, MI (US); Cem U. Saraydar, Royal Oak, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 299 days.

(21) Appl. No.: 12/140,031

(22) Filed: Jun. 16, 2008

(65) Prior Publication Data

US 2009/0309757 A1 Dec. 17, 2009

(51) Int. Cl.
*G06G 1/00* (2006.01)

(52) U.S. Cl. ..... 340/902; 340/903; 340/905; 340/907; 340/934; 340/936; 340/937; 340/988; 340/989; 340/995.1; 701/1; 701/117; 701/119; 701/207; 701/209

(58) Field of Classification Search ..... 340/902, 340/903, 905, 907, 934, 936, 937, 988, 989, 340/995.1; 701/1, 117, 119, 207, 209
See application file for complete search history.

(56) References Cited

U.S. PATENT DOCUMENTS 6,249,232 B1 * 6/2001 Tamura et al. ..... 340/902
6,615,137 B2 * 9/2003 Lutter et al. ..... 701/301
2004/0215373 A1 10/2004 Won et al.
2007/0252723 A1 11/2007 Boss et al.
2008/0065311 A1 3/2008 Bauchot et al.

FOREIGN PATENT DOCUMENTS

JP 2003272095 9/2003

* cited by examiner

*Primary Examiner*—Tai T Nguyen
(74) *Attorney, Agent, or Firm*—John A. Miller; Miller IP Group, PLC

(57) ABSTRACT

A system and method for providing real-time traffic information using a wireless vehicle-to-vehicle communications network. A vehicle includes a plurality of sensors that detect other vehicles around the vehicle. The wireless communications system on the vehicle uses the sensor signals to calculate a traffic condition index that identifies traffic information around the vehicle. The vehicle broadcasts the traffic condition index to other vehicles and/or road side infrastructure units that can present the information to the vehicle driver, such as in a navigation system, and/or rebroadcast the traffic information to other vehicles. The traffic condition index can be calculated using the speed of the surrounding vehicles, posted speed limits, the distance between the surrounding vehicles and the traffic density of the surrounding vehicles.

20 Claims, 2 Drawing Sheets

REAL TIME TRAFFIC AIDE

BACKGROUND OF THE INVENTION

1. Field of the Invention

This invention relates generally to a vehicle communications system that provides real-time traffic information and, more particularly, to a wireless vehicle-to-vehicle communications system where vehicles equipped with the system broadcast information about surrounding traffic that is then received and used and/or re-transmitted by other vehicles.

2. Discussion of the Related Art

Driver convenience systems, such as turn-by-turn navigation systems and digital map based navigation systems have been in development and use for some time, and have received favorable reviews for the benefits they provide to drivers. Some vehicle manufacturers have incorporated these types of systems in their vehicles or intend to have them in production in the near future.

Traffic accidents and roadway congestion are significant problems for vehicle travel. Providing continuous traffic information to a vehicle driver is available in today's vehicles through, for example, XM radio. One of the challenges in current traffic information systems is that the information is not in real-time, which means that there may be a considerable delay between collecting the traffic information and presenting it to a particular vehicle driver where sometimes the information may be outdated or misleading.

Vehicular ad-hoc network based active safety and driver assistance systems allow a wireless vehicle communications system to transmit messages to other vehicles in a particular area with warning messages about driving conditions. In these systems, multi-hop geocast routing protocols, known to those skilled in the art, are commonly used to extend the reachability of the warning messages, i.e., to deliver active messages to vehicles that may be a few kilometers away, as a one-time multi-hop transmission process. In other words, an initial message advising drivers of a certain situation is transferred from vehicle to vehicle using the geocast routing protocol so that relevant vehicles a significant distance away will receive the messages where one vehicle's direct transmission distance (range) is typically relatively short.

Vehicle-to-vehicle and vehicle-to-infrastructure applications require a minimum of one entity to send information to another entity. For example, many vehicle-to-vehicle safety applications can be executed on one vehicle by simply receiving broadcast messages from a neighboring vehicle. These messages are not directed to any specific vehicle, but are meant to be shared with a vehicle population to support the safety application. In these types of applications where collision avoidance is desirable, as two or more vehicles talk to each other and a collision becomes probable, the vehicle systems can warn the vehicle drivers, or possibly take evasive action for the driver, such as applying the brakes. Likewise, traffic control units can observe the broadcast of information and generate statistics on traffic flow through a given intersection or roadway.

SUMMARY OF THE INVENTION

In accordance with the teachings of the present invention, a system and method are disclosed for providing real-time traffic information using a wireless vehicle-to-vehicle communications network. A vehicle includes a plurality of sensors that detect other vehicles around the vehicle. The wireless communications system on the vehicle uses the sensor signals to calculate a traffic condition index that identifies traffic information around the vehicle. The vehicle broadcasts the traffic condition index to other vehicles and/or road side infrastructure units that can present the information to the vehicle driver, such as in a navigation system, and/or rebroadcast the traffic information to other vehicles. The traffic condition index can be calculated using the speed of the surrounding vehicles, posted speed limit, the distance between the surrounding vehicles and the traffic density of the surrounding vehicles.

Additional features of the present invention will become apparent from the following description and appended claims, taken in conjunction with the accompanying drawings.

DETAILED DESCRIPTION OF THE EMBODIMENTS

The following discussion of the embodiments of the invention directed to a system and method for providing real-time traffic information using wireless vehicle communications is merely exemplary in nature, and is in no way intended to limit the invention or its applications or uses.

Figure 1:
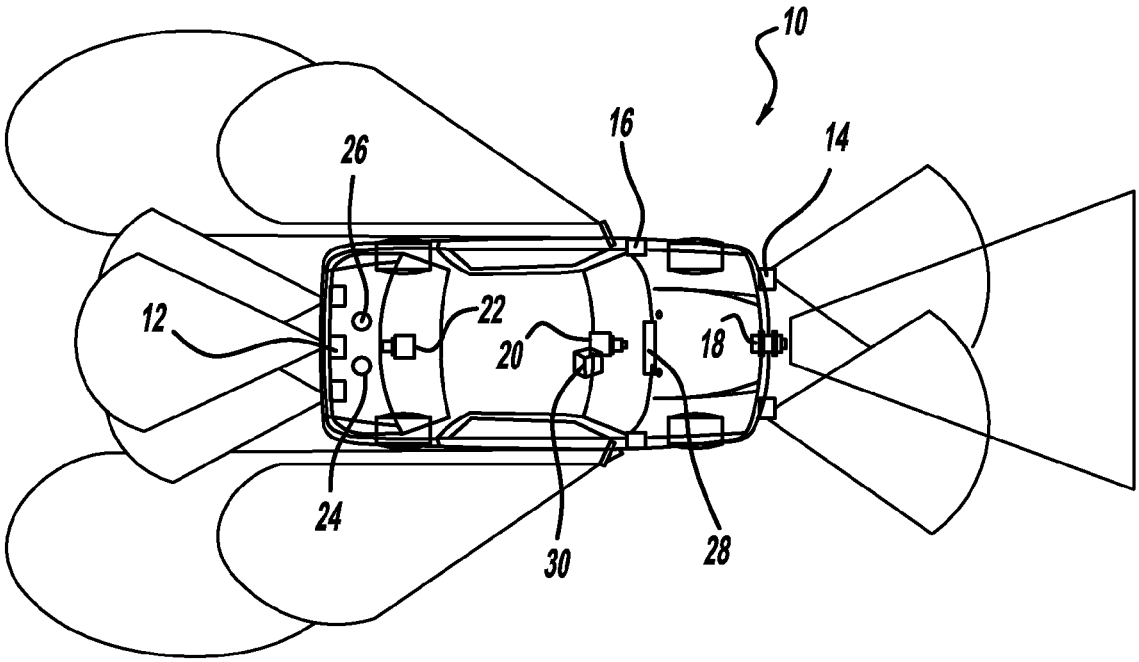
FIG. 1 is a plan view of a vehicle employing various vehicle sensors, cameras, detectors and communications systems.

FIG. 1 is a plan view of a vehicle 10 including various sensors, vision systems, controllers, communications systems, etc., one or more of which may be applicable for the wireless communications system discussed below. The vehicle 10 may include mid-range sensors 12, 14 and 16 at the back, front and sides, respectively, of the vehicle 10. A front vision system 20, such as a camera, provides images towards the front of the vehicle 10 and a rear vision system 22, such as a camera, provides images towards the rear of the vehicle 10. A GPS or a differential GPS system 24 provides location information, and a vehicle-to-vehicle (V2V) wireless communications system 26 provides communications between the vehicle 10 and other structures, such as other vehicles, road-side systems, etc., as is well understood to those skilled in the art. The vehicle 10 also includes an enhanced digital map (EDMAP) 28 and an integration controller 30 that integrates the information from the various devices in the manner discussed below and provides 360° sensing data fusion.

The present invention proposes a real-time traffic information network where vehicles that are equipped with suitable sensors and a wireless communication system continuously monitor their surrounding traffic and communicate this information to other vehicles wirelessly through vehicle-to-vehicle communications. Upon receiving traffic information from other vehicles, the receiving vehicle will analyze the information and can then present the information to the driver upon the drivers request or through preset conditions. Such information may include alternative routes to a destination with distances and time estimates based on the real-time traffic information, recommended faster routes per the drivers request, recommended shortest route, and overlaying the traffic information on the vehicle navigation display when available. This feature helps a driver by reducing waiting time in congested traffic, and also helps the driver and society with general fuel savings and reduction in air pollution. The vehicle communications system can also transmit the information concerning traffic at another location to other vehicles.

The present invention further proposes that vehicles detect local traffic information using vehicle-to-vehicle communications and on-board sensors. On-board data fusion algorithms process vehicle information from the sensors, vehicle positioning systems, such as GPS, and navigation digital maps to derive traffic information pertaining to current vehicle geographic location and present this information in an efficient and compact form that represents the local traffic properties for the vehicle's geographic location. This traffic information can include geographic location, local traffic density, average vehicle distances, average vehicle speed, etc. A traffic-condition index can be calculated based on the weighted sum of the various traffic condition factors.

A vehicle can broadcast location specific compact traffic information packets from vehicle to vehicle (V2V) or vehicle to infrastructure to vehicle (V2I2V) using appropriate communications technology, such as DSRC, WiFi, WiMax, etc. The communication and the information exchange between vehicles can be either direct or can be multi-hop. With the use of WiMax, the coverage area may be extended a few miles. Hence communications between vehicles far apart can be achieved without the need for an intermediate step. A vehicle can receive location specific traffic data, for example, the traffic condition index and originating location, from other vehicles, combine this information with the driver's route plan and navigation maps to estimate travel times, travel distances and alternative routes. The signal processing may eliminate any information outside a range when it is predetermined that the originating location is beyond a predetermined distance threshold.

Figure 2:
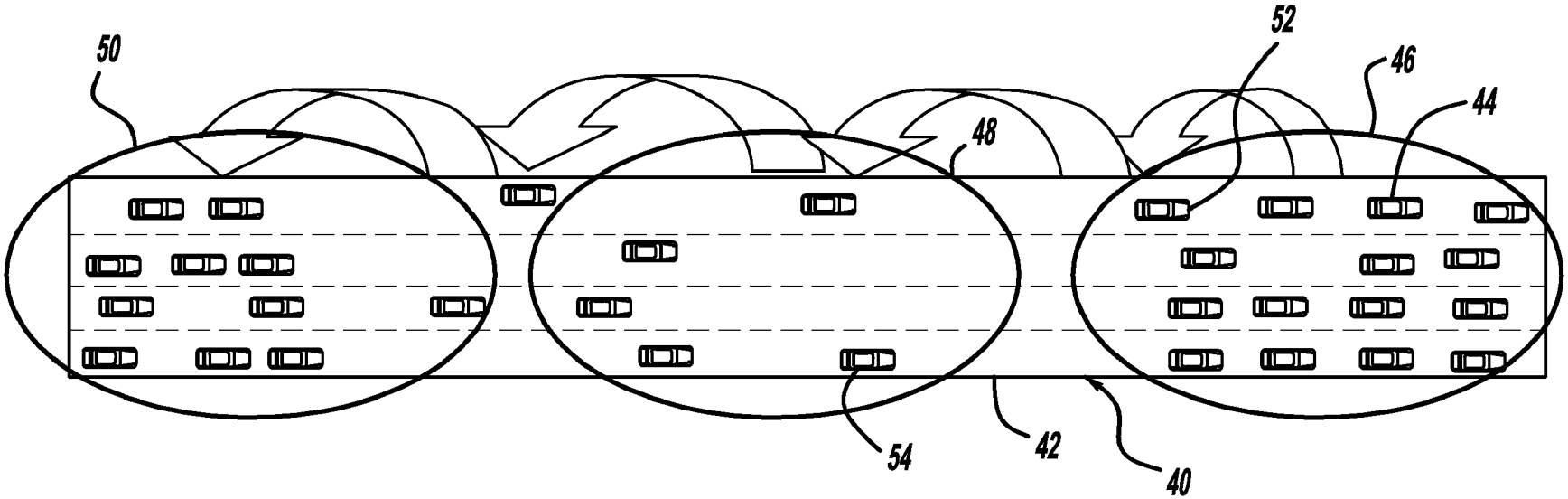
FIG. 2 is a representation of groups of vehicles traveling along a roadway where some of the vehicles may be broadcasting wireless communications to other vehicles concerning real-time traffic information, according to an embodiment of the present invention.

FIG. 2 is a plan view of a roadway 40 including a plurality of travel lanes 42. Vehicles 44 traveling along the lanes 42 can be identified as being part of vehicle clusters 46, 48 and 50. A particular vehicle, such as vehicle 52 in the leading cluster 46, may include the capability of detecting the other vehicles 44 around it using various sensors, such as radar, lidar sensors, radio frequency (RF) range sensors, proximity sensors, wireless devices, cameras, etc., and then transmitting information about traffic density to the other clusters 48 and 50 in a multi-hop communication type configuration. Thus, a vehicle 54 within the cluster 48 may receive the communication from the vehicle 52, and use it in its own algorithm that determines traffic density and/or rebroadcast the information to other clusters, such as the cluster 50 to be received by other vehicles. In addition, the vehicle 54 can transmit information about its traffic density to other clusters.

Figure 3:
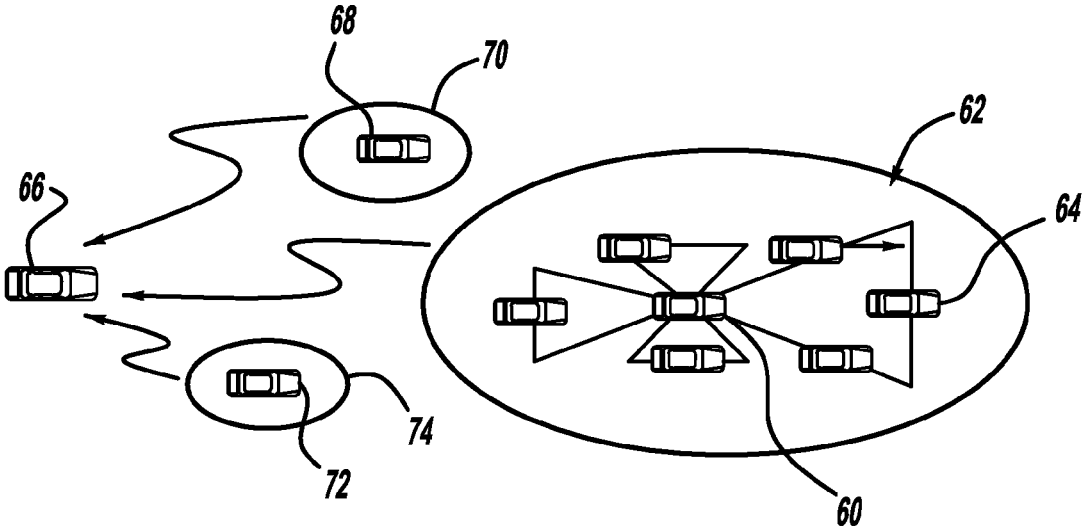
FIG. 3 is a representation of a vehicle transmitting wireless communications to other vehicles concerning traffic information, according to an embodiment of the present invention.

FIG. 3 is a representation of how a particular vehicle may use information received by other vehicles concerning traffic density. In this example, a vehicle 60 in a cluster 62 detects other vehicles 64 in the cluster 62 and transmits information concerning traffic conditions to a host vehicle 66. The vehicle 60 can calculate the average velocity of the vehicles in the cluster 62, the average distance between the vehicles in the cluster 62 and the numbers of vehicles within the cluster 62. Additionally, other vehicles, such as vehicle 68 in traffic cluster 70 and vehicle 72 in traffic cluster 74, can transmit information to the host vehicle 66 concerning traffic in their clusters. The host vehicle 66 receives the detected traffic information from the clusters 62, 70 and 72 and calculates the traffic situation between its current position and its destination. The system can provide this information to the driver who can take suitable action.

The vehicles can transmit a traffic condition index TC that identifies the traffic condition around the particular vehicle. The traffic condition index TC can be calculated as follows using an average traffic-flow speed Vt, an average vehicle distance Dv and an average traffic density Dt.

A vehicle speed factor Fs can be determined by $Fs=K1*(Vsl-Vt)$ if $Vt<Vsl$, where Vsl is the posted speed limit, and $Fs=0$ if $Vt>Vsl$.

A vehicle distance factor Fvd can be determined by $Fvd=K2*(Dvth-Dv)$ if $Dvth>Dv$, where Dvth is a predetermined threshold level for vehicle distances, and where $Fvd=0$ if $Dvth<Dv$.

A traffic density factor Ftd can be determined by $Ftd=K3*(Dtth-Dt)$ if $Dt>Dtth$, where Dtth is a predetermined threshold level for vehicle distances, and $Ftd=0$ if $Dtth>Dt$.

A traffic condition factor F can be determined by $F=Fs+Fvd+Ftd$. In an alternate embodiment, each of the speed factor Fs, the vehicle distance factor Fvd and the traffic density factor Ftd can be weighted differently in various applications.

The traffic condition index TC can then be determined for broadcast, such as $TC=1$ if $F<Fth1$, $TC=2$ if $Fth1<F<Fth2$ and $TC=3$ if $Fth2<F$, where Fth1 and Fth2 are predetermined traffic-condition factor thresholds, with the number of the levels predetermined for the most effective communication of the traffic condition.

The present invention provides a number of advantages for vehicle travel and safety. Particularly, the calculation of the traffic condition index TC provides real-time traffic information at very little extra communication overhead and cost. Further, determining the real-time traffic condition index TC does not depend on infrastructure support or third party sensing systems. Further, existing production automatic cruise control systems and FCW radar, lidar, camera and/or communications sensors can be used to sense the traffic. Also, existing navigation systems can be used to provide information to the driver.

The discussion above concerns providing traffic information around a vehicle that is transmitted to other vehicles using a wireless vehicle communications system. In alternate embodiments, other things can be detected by the vehicle using the various vehicle sensors discussed above. These other things include, but are not limited to, infrastructure along the roadway and road conditions. For example, cameras on the vehicle can detect signs, bridges, etc. as the vehicle travels along the roadway, which can be broadcast to other drivers, used by other applications on the detecting vehicle or be displayed to the driver for various uses. Further, vehicle sensors, such as chasse sensors, tire slip detectors, etc. can detect road conditions, such as icy roads, which can also be used by other vehicle applications, displayed to the driver or broadcast to other vehicles in the manner as discussed above.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A traffic system for providing real-time traffic information from one vehicle to other vehicles, said system comprising:

a plurality of sensors provided on the one vehicle, said sensors detecting surrounding vehicles and traffic around the one vehicle; and a wireless communications system responsive to sensor signals from the sensors, said wireless communications system including a controller that calculates a traffic condition index identifying the traffic around the one vehicle and broadcasting the traffic condition index to the other vehicles, said controller calculates the traffic condition index using a vehicle speed factor of a speed of the surrounding vehicles and a vehicle distance factor of a distance between the surrounding vehicles, wherein at least one of the other vehicles re-broadcasts the traffic condition index to other vehicles.

2. The traffic system according to claim 1 wherein the controller calculates the traffic condition index using a traffic density factor of the density of the surrounding vehicles.

3. The traffic system according to claim 2 wherein the controller calculates a traffic condition factor that is a sum or a weighted sum of the vehicle speed factor, the vehicle distance factor and the traffic density factor, said traffic condition factor being used to determined the traffic condition index.

4. The traffic system according to claim 3 wherein the traffic condition index is a number based on a comparison of the traffic condition factor to one or more thresholds.

5. The traffic system according to claim 1 where the plurality of sensors include cameras, radar sensors, lidar sensors, radio frequency (RF) range sensors, proximity sensors, wireless devices, GPS receivers and data fusion sensors.

6. The traffic system according to claim 1 wherein the controller presents the traffic condition index in a predetermined format to a driver of the vehicle.

7. The traffic system according to claim 6 wherein the controller presents the traffic condition index to the driver as alternate routes on a navigation system.

8. The traffic system according to claim 1 wherein the wireless communications system also provides information concerning things detected along the vehicle roadway other than traffic.

9. The traffic system according to claim 8 where the other things include hazardous road conditions.

10. The traffic system according to claim 8 wherein the other things include infrastructure along the roadway.

11. A traffic system for providing real-time traffic information from one vehicle to other vehicles, said system comprising:

a plurality of sensors provided on the one vehicle, said sensors detecting surrounding vehicles and traffic around the one vehicle; and a wireless communications system responsive to sensor signals from the sensors, said wireless communications system including a controller that calculates a traffic condition index identifying the traffic around the one vehicle and broadcasting the traffic condition index to the other vehicles, said controller calculating the traffic condition index using a vehicle speed factor of a speed of the surrounding vehicles, a vehicle distance factor of a distance between the surrounding vehicles and a traffic density factor of a density of the surrounding vehicles, said controller presenting the traffic condition index in a predetermined format to a driver of the vehicle, wherein at least one of the other vehicles re-broadcasts the traffic condition index to other vehicles.

12. The traffic system according to claim 11 wherein the controller calculates a traffic condition factor that is a sum or a weighted sum of the vehicle speed factor, the vehicle distance factor and the traffic density factor, said traffic condition factor being used to determined the traffic condition index.

13. The traffic system according to claim 12 wherein the traffic condition index is a number based on a comparison of the traffic condition factor to one or more thresholds.

14. The traffic system according to claim 11 where the plurality of sensors include cameras, radar sensors, lidar sensors, radio frequency (RF) range sensors, proximity sensors, wireless devices, GPS receivers and data fusion sensors.

15. The traffic system according to claim 11 wherein the controller presents the traffic condition index to the driver as alternate routes on a navigation system.

16. The traffic system according to claim 11 wherein the wireless communications system also provides information concerning things detected along the vehicle roadway other than traffic.

17. The traffic system according to claim 16 where the other things include hazardous road conditions.

18. The traffic system according to claim 16 wherein the other things include infrastructure along the roadway.

19. A method for providing real-time traffic information from one vehicle to other vehicles, said method comprising:

detecting surrounding vehicles and traffic density around the one vehicle using sensors; and calculating a traffic condition index identifying the traffic density around the one vehicle, wherein calculating the traffic condition index includes using a speed factor of a speed of the surrounding vehicles, a vehicle distance factor of a distance between the surrounding vehicles and a traffic density factor of a density of the surrounding vehicles; and broadcasting the traffic condition index to the other vehicles, wherein at least one of the other vehicles re-broadcasts the traffic condition index to other vehicles.

20. The method according to claim 19 wherein calculating a traffic condition index includes calculating a traffic condition factor that is a sum or a weighted sum of the vehicle speed factor, the vehicle distance factor and the traffic density factor, said traffic condition factor being used to determined the traffic condition index.

* * * * *